US008106288B2

(12) United States Patent
Shaffer

(10) Patent No.: US 8,106,288 B2
(45) Date of Patent: Jan. 31, 2012

(54) METHODS AND APPARATUS FOR TRANSMITTING FINGER POSITIONS TO STRINGED INSTRUMENTS HAVING A LIGHT-SYSTEM

(75) Inventor: John R Shaffer, Windham, NH (US)

(73) Assignee: Optek Music Systems, Inc., Reno, NV (US)

( * ) Notice: Subject to any disclaimer, the term of this patent is extended or adjusted under 35 U.S.C. 154(b) by 0 days.

(21) Appl. No.: 12/953,875

(22) Filed: Nov. 24, 2010

(65) Prior Publication Data

US 2011/0247478 A1 Oct. 13, 2011

Related U.S. Application Data

(63) Continuation of application No. 12/017,811, filed on Jan. 22, 2008, now Pat. No. 7,863,514, which is a continuation of application No. 11/308,715, filed on Apr. 25, 2006, now Pat. No. 7,323,633.

(60) Provisional application No. 60/674,798, filed on Apr. 26, 2005.

(51) Int. Cl.

| | |
|---|---|
| ***G10H 1/32*** | (2006.01) |
| ***G10H 3/00*** | (2006.01) |
| ***A63J 17/00*** | (2006.01) |

(52) U.S. Cl. ..... 84/746; 84/464 A; 84/645

(58) Field of Classification Search ..... 84/464 R, 84/464 A, 477 R, 478, 746

See application file for complete search history.

(56) References Cited

U.S. PATENT DOCUMENTS

| | | | |
|---|---|---|---|
| 4,915,005 | A | 4/1990 | Shaffer et al. |
| 5,266,735 | A | 11/1993 | Shaffer et al. |
| 5,394,784 | A | 3/1995 | Pierce et al. |
| 5,408,914 | A | 4/1995 | Breitweiser, Jr. et al. |
| 6,025,550 | A | 2/2000 | Kato |
| 6,191,348 | B1 | 2/2001 | Johnson |
| 6,337,433 | B1 | 1/2002 | Nishimoto |
| 6,342,663 | B1 | 1/2002 | Kato |
| 6,452,081 | B1 | 9/2002 | Ravagni et al. |
| 6,660,922 | B1 | 12/2003 | Roeder |
| 6,751,439 | B2 | 6/2004 | Tice et al. |
| 2004/0182219 | A1 | 9/2004 | Sasaki |
| 2005/0126365 | A1 | 6/2005 | Shaffer |

FOREIGN PATENT DOCUMENTS

| | | |
|---|---|---|
| WO | WO 2005/004030 A2 | 1/2005 |

OTHER PUBLICATIONS

International Search Report and Written Opinion issued in International Patent Application No. PCT/US06/16248; Date of Mailing: Jan. 3, 2007 (6 pages). Supplementary European Search Report and Opinion issued in European Application No. 06758737; Date of Completion: Nov. 25, 2009; Date of Mailing: Dec. 1, 2009 (8 pages).

*Primary Examiner* — Jeffrey Donels

(74) *Attorney, Agent, or Firm* — Finnegan, Henderson, Farabow, Garrett & Dunner, LLP

(57) ABSTRACT

The invention provides systems and methods of for displaying on a second instrument finger positions that were played on a first instrument. A teacher, for example, can play notes and/or chords on a first stringed instrument having a sensor. A processing having a decoder and a message generator can receive signals from the sensor and generate messages that are communicated to a light-system in the second instrument. The light-system displays the finger positions on the second instrument, each finger position corresponding to a finger position played on the first instrument. The processor can receive sensor information from the second information that can be used to determine whether a displayed finger position was correctly played on the second instrument.

28 Claims, 5 Drawing Sheets

METHODS AND APPARATUS FOR TRANSMITTING FINGER POSITIONS TO STRINGED INSTRUMENTS HAVING A LIGHT-SYSTEM

This is a continuation of application Ser. No. 12/017,811, filed Jan. 22, 2008, now U.S. Pat. No. 7,863,514 which is a continuation of application Ser. No. 11/308,715, filed Apr. 25, 2006, now U.S. Pat. No. 7,323,633, and claims the benefit of U.S. Provisional Application No. 60/674,798, filed Apr. 26, 2005, all of which are hereby incorporated by reference in their entirety.

CROSS REFERENCE TO RELATED APPLICATIONS

This application claims priority to U.S. Provisional Patent Application No. 60/674,798 entitled, "Methods and Apparatus For Transmitting Finger Positions To Stringed Instruments Having A Light-System," by John R. Shaffer filed Apr. 26, 2005, incorporated herein by reference in its entirety.

BACKGROUND OF THE INVENTION

Learning to play the Guitar is difficult and time consuming. Even with an instructor, learning to play well can be challenging at best. One particular difficulty is learning the layout of the notes on a guitar fretboard and learning to press the correct strings (known as fretting). In a conventional learning scenario a novice player looks at diagrams of chords and scales displayed in a book, sheet music, chord chart, or on a computer screen, and attempts to place his of her fingers on the guitar fretboard corresponding to information on the diagram. This task is painstakingly slow and arduous and much of the information is lost in translating the information from text to fretboard. In addition, physical movement of the player's eyes from the diagram to the fretboard can cause confusion. Students are invariably relegated to a head-bobbing motion, back and forth, from diagram to guitar, until they place their fingers in the correct positions.

In some cases, a student will hire a guitar teacher to show them the correct finger positions. The teacher will place his or her fingers in a correct position on a guitar and the student will look on and attempt to mimic the teacher's movements. However, this approach suffers from the same drawbacks as the student looking at a book—the student must look back and forth between the student's guitar and the teacher's guitar. Another drawback is that guitar teachers can usually only teach one or two students at a time, making lessons expensive.

Accordingly, there exists a need to efficiently and effectively teach one or more students to play a musical instrument, and in particular, to play a stringed instrument.

SUMMARY OF THE INVENTION

The present invention provides apparatus and methods for teaching one or more students to play a musical instrument, and in general, a stringed instrument. In one embodiment, the apparatus provides recognition of finger positions played on a first stringed instrument, and causes those finger positions to be displayed or otherwise illuminated on one or more second stringed instruments. For example, a teacher can play notes and/or chords (hereinafter collectively and interchangeable referred to as "chords") on the first instrument. One or more students can each have a second instrument each having a light-system. The apparatus detects finger positions played on the first instrument and transmits them to the one or more second instruments whereupon the light-system in each of the second instruments displays the finger positions. Thus, the finger positions played by the teacher are displayed on the one or more student-instruments. Advantageously, this provides for methods of teaching one or more students to play stringed instruments without the need for head-bobbing, translating chord diagrams, and the like.

In another embodiment, the apparatus provides for transmitting chord patterns played on a first instrument to one or more second instruments each having a light-system, where the second instruments are coupled to a processor in communication with a processor coupled to the first instrument. The first and second processors may be the same processor, or they may be different ones. The processors may communicate in a variety of ways including wired and wireless communications, such as networked, Internet communications, Bluetooth™, or they can utilize other technologies.

In still another embodiment, the apparatus can utilize a pre-recorded lesson that comprises musical notes and/or instructions, and also comprises finger positions that can be read from that pre-recording and displayed on one or more second instruments. Thus, although a teacher may be involved in the recording of the "lesson," that teacher need not be present for the students to receive instruction on playing the stringed instruments. In a related aspect, the recording need not be directed toward a lesson per se, but rather, could be a recording artist, concert or other recording enabling the player(s) of the second instrument(s) to copy or otherwise play along with the recording artist.

In another aspect, the apparatus can detect the finger positions played on one or more second instrument thereby providing feedback to a teacher for determining whether the students' fingers are properly placed and/or if the student is playing the correct notes.

Further still, in another embodiment, a musical performer can play a first instrument, as described above, and his or her finger positions can be broadcast via Internet, satellite or other means, to an audience each having a second instrument with a light-system. Thus, members of the audience can see the finger positions used by the performer.

Other embodiments are envisioned and are within the scope of this application, and those embodiments will be appreciated by those skilled in the art.

BRIEF DESCRIPTION OF THE DRAWINGS

Additional benefits and advantages of the present invention will become apparent to those skilled in the art to which this invention relates from the subsequent description of illustrated embodiments and the appended claims, taken in conjunction with the accompanying drawings, in which:

DETAILED DESCRIPTION OF THE INVENTION

Figure 1:
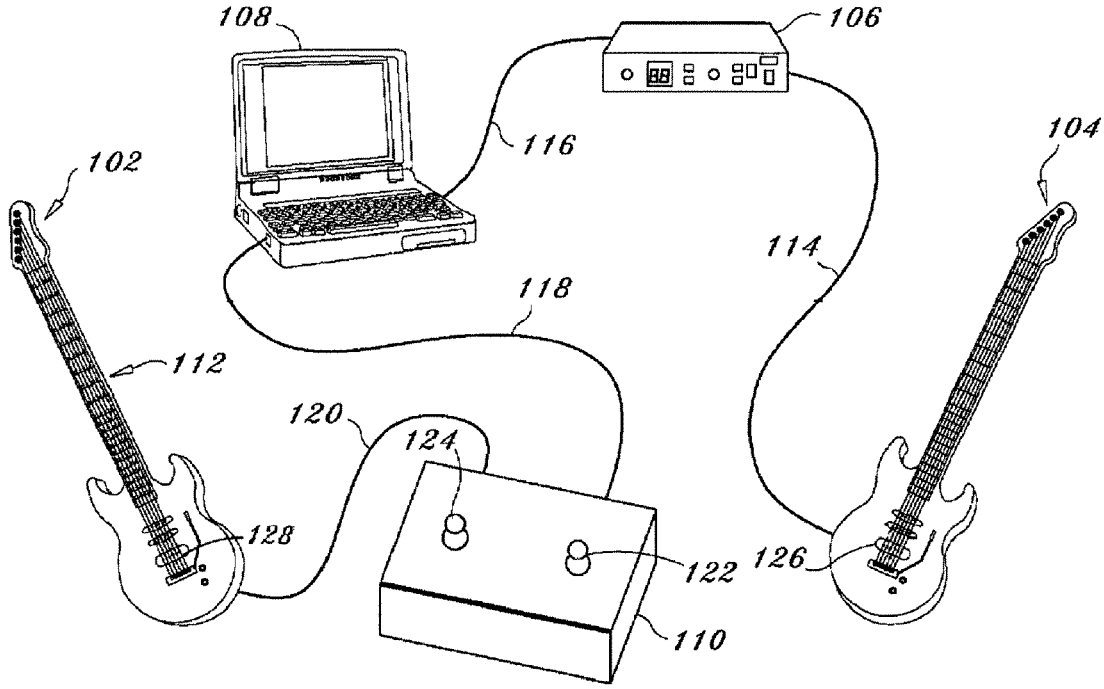
FIG. 1 shows an embodiment of the invention having a first stringed instrument with a sensor that is coupled to a digital processor executing a program that detects finger positions played on that instrument and communicates those finger positions to a second instrument having a light-system that displays those finger positions on the second instrument.

The invention provides, in one embodiment, apparatus and methods for displaying on a second instrument having a light system, finger positions played on a first instrument. A first person, such as but not limited to a teacher, instructor or performer, can play the first instrument by pressing down on its strings at one or more finger positions, e.g., in the usual manner of playing that instrument. The finger positions relate to notes and/or chords (herein, "notes" and "chords" are used interchangeably, and "finger positions" refer to the finger positions used while playing a note, notes and/or chords). Those finger positions can be detected and/or identified by the apparatus, and transmitted to one or more second instruments, each of those having a light system that can display finger positions.

The methods and apparatus disclosed herein are described in terms of use with a "guitar" or "stringed instrument," however, the present invention is not limited to a guitar or stringed instrument, but rather, can be used with any instrument having finger positions. For example, a guitar (acoustic, electric, base, 6 string, 12 string), banjo, piano, keyboard (electronic), violin, cello, brass instrument, wind instrument, and combinations thereof. In addition, one skilled in the art will appreciate that different types of instruments can be used together with the systems described herein. For example, a teacher could play notes and/or chords on a keyboard instrument and the apparatus can display appropriate finger positions to be played on a stringed instrument, e.g., a guitar. Thus, finger positions that are displayed on the second instrument can be based on notes and/or chords played on the first instrument via a translation or interpretation, for example. Further, references herein to "a" or "the" second instrument should be understood to include one or more second instruments, as it will become apparent that the embodiments illustrated herein are directed to one or more second instruments and each second instrument can be of a varying type, e.g., those types listed above.

In one embodiment, at least one of the instruments is a guitar having a light system. For example, light systems such those described in U.S. Pat. Nos. 5,266,735 and 4,915,005, hereby incorporated by reference in their entirety, have been shown to be useful. Further, stringed instruments utilizing those light-systems can also utilize fingerboards that can accommodate light-emitting devices including LEDs, such as fingerboards described in U.S. patent application Ser. No. 11/005,828, filed Dec. 7, 2005 by John R. Shaffer, and entitled, "Stringed Instrument Fingerboard For Use With a Light-System," which is also incorporated herein in its entirety.

Finger positions played on a first instrument can be displayed or otherwise illuminated on one or more second instruments, allowing players of the second instruments to visually identify finger positions played on the first instrument. In one embodiment, the finger positions can be illuminated on the second instruments in near real-time (e.g., virtually or nearly simultaneously) with the playing of the first instrument, allowing students to quickly identify a finger position or positions played by a teacher. That avoids the necessity of the student translating chart diagrams, or head-bobbing between the teacher's instrument and his or her own instrument. In another embodiment, finger positions can be displayed on the second instrument for longer time period, e.g., the positions are "painted" on the second instrument, allowing a student to study the finger position for that time period. Further, because the teacher's finger positions can be transmitted to a plurality of students via, for example, digital communication technologies, a single teacher can display finger positions on a group of second instruments each of which has a light-system that can be coupled to its own processor to receive the finger positions from a processor coupled to the teacher's instrument. Thus, a teacher's finger positions can transmitted to multiple instruments each located at different physical locations, e.g., each at the player's home or office.

FIG. 1 illustrates one embodiment of apparatus according to the invention having a decoder 106, a message generator 108 and a footswitch 110. The decoder 106 receives information, e.g., string data, from a sensor 126 mounted on or embedded in a first instrument 104 illustrated as a six-stringed guitar, and decodes and/or identifies notes and or chords played on the first instrument. The message generator 108 receives that note/chord information and determines finger positions played on the first stringed instrument 104. Based on those finger positions, message generator 108 generates and communicates messages to a light-system 112 in a second instrument 102 also illustrated as a six-stringed guitar. The light-system 112 displays or otherwise illuminates those finger positions on the second instrument. Footswitch 110 is electrically disposed between the system 100 and the light-system 112, and can toggle or otherwise select operational features of the light-system 112 and/or message generator 108. Thus, the apparatus provides for identifying finger positions played on a first instrument 104 and displaying those finger positions on the second instrument 102 having a light-system 112.

Decoder 106 illustrated is a Musical Instrument Digital Interface (hereinafter, "MIDI") decoder that receives string information from a MIDI sensor 126 (also commonly referred to as a "MIDI Pick-up") via electrical connection/cable 114. By way of brief background, MIDI is a protocol designed for representing notes played on an instrument as a set of metrics. Rather than sensing and digitizing music, for example as a so-called wave file ("WAV") or other analog-to-digital conversion of music itself, MIDI generates quantified metrics representing the notes of the music. For example, a MIDI protocol can represent a note using a numeric, e.g., note 1 through note 128 where note 1 is the lowest note and note 128 is the highest note. A MIDI protocol can represent a played note by "note-on" and "note-off" metrics indicating the duration of that note and its temporal relation to other notes played, e.g., duration of 1 through 128. It can represent a note's intensity, for example, where intensity of 1 can be very soft while an intensity of 128 can be very loud.

With that understanding of MIDI protocol, decoder 106 analyzes sensor information outputs data and outputs metrics representing (at least) notes played on first instrument 104. Decoder 106 is preferably matched or otherwise compatible with sensor 126, as noted above. Sensor 126 can identify notes played along any of six strings illustrated on the first instrument 104, such being a six-stringed guitar. Decoder 106 can, in one embodiment, sense each vibrating string via sensor 126 in a round-robin fashion, or can receive information relative to each string in a parallel fashion, or a combination thereof. In another embodiment, decoder 106 receives string information only when a string is vibrating and/or has an amplitude exceeding a threshold, for example. Although sensor 126 can determine and relay to decoder 106 a frequency of each vibrating string, in one embodiment, it can also determine and relay amplitude and/or tonal aspects of one or more strings such as note attack, vibrato, and other characteristics. Decoder 106 has the capability to filter extraneous vibrations such as harmonics and the like, as well as the ability to determine when a note or vibration changes in frequency to determine when and/or if a subsequent note or chord has been played.

Thus, although a MIDI sensor and decoder are illustrated, it will be appreciated by those skilled in the art that other protocols can be used, and indeed, techniques other than quantified metrics can be utilized as along as decoder 106 and sensor 126 are compatible, e.g., that sensor can transmit to decoder string data (e.g., frequency of strings) played on the first instrument, and decoder can determine notes and/or chords played based on the received string data.

Thus, MIDI sensor 126, as stated above, can have a plurality of sensors, one sensor for each string of the instrument 104. In the illustrated embodiment of a six-string guitar 104, MIDI sensor 126 preferably has six sensors (e.g., detectors), one for each string of the guitar. In one embodiment using a four-string bass guitar, a MIDI pickup can have four string sensors, one for each of the four strings of that bass guitar, or it can have a multiple of four string sensors where each string sensor can sense differing characteristics of a single string, e.g., frequency, duration, amplitude, or even the same characteristics for redundancy for increased measurement precision. In one embodiment, sensor 126 contains electronics that can perform filtering or can digitize string information before transmitting the information to decoder 106. Further, sensors 126 can be microphones or of crystal based technologies, or can be of an optical variety, all of which are advantageous in the case where strings are non-metallic or otherwise non-detectable using magnetic sensing techniques. In embodiments where sensor 126 requires power, electrical cable 114 can be adapted to provide that power from a source within decoder 106, or from battery packs, or otherwise.

Sensor 126 as illustrated generates a sine-wave or quasi-sine wave signals, also referred to as vibration data, having at least one cycle or period at or near the frequency of the vibrating string, and an amplitude corresponding to an amplitude of that vibrating string. Decoder 106 is therefore capable of receiving the "wave" based signals and determining attributes of the note played, e.g., identifying the note and generating quantified metrics as described above. There are, of course, other techniques of detecting a frequency and amplitude of vibrating strings, and some of those techniques have been successfully adapted to musical instruments having strings and will be appreciated by those skilled in the art.

As illustrated, cable 114 is adapted to be a MIDI cable having a so-called MIDI connector to couple with decoder 106. In one embodiment where sensor 126 can be powered via batteries and information can be transmitted to decoder 106 via wireless techniques, batteries can be provided for power requirements. Alternatively or in conjunction with, sensor 126 may have analog to digital conversion capability to facility digital transmission with decoder 106, and/or can also receive data from decoder 106 in a bi-directional manner. In such embodiment, cable 114 can be adapted for use with those decoders and sensors. Other configurations are possible and may be useful as long decoder 106 and sensor 126 can communicate as required.

Message generator 108 receives data from the decoder 106 via electrical cable 116 and generates messages having finger position data instructing the light-system 112 in the second instrument 102 to illuminate one or more LEDs thereby displaying the finger positions that were played on the first instrument 104. Message generator 108 can process the quantified data from the decoder 106 in a wide variety of ways. For example, message generator 108 can generate and transmit in near real-time to the second instrument 102 finger position data reflecting finger positions that were played on the first instrument 104. Alternatively, or together with, message generator 108 can store or otherwise record (e.g., on disk, DVD/HDDVD, CD, or other storage media) finger positions (e.g., finger position data) played on the first instrument 104, optionally with additional MIDI data, WAV files, video content or other data, and can be "played" or "re-played" thereafter. Those recordings can be useful for pre-recorded lessons and can provide a "play along" opportunity for prior concerts or artist recordings, and other uses are envisioned and will be appreciated.

Figure 2:
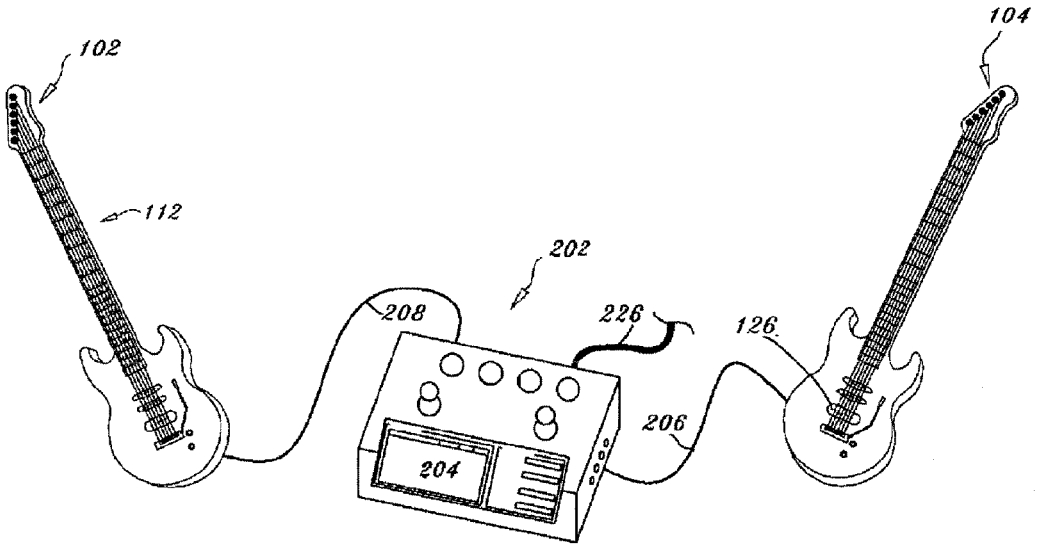
FIG. 2 illustrates an embodiment of the invention having footswitch with a decoder and a message generator that detects finger positions played on a first instrument and communicates those finger positions to a second instrument having a light-system that displays those finger positions on the second instrument.

Message generator 108 has a program, e.g., a computer program, implemented on a lap-top computer system, although such program and indeed, a message generator, can be implemented on any system, hardware and/or firmware that is capable of receiving note and/or chord data from decoder 106 and generating messages suitable for a light-system to illuminate finger positions. In one embodiment, message generator 108 and decoder 106 are implemented in a single enclosure, and/or can be implemented using one or more processors, either shared or discrete, and this is illustrated below (FIG. 2). Of course, either or both of the message generator 108 and decoder 106 can be implemented using virtually any combination of hardware, software and/or firmware, whether shared or stand-alone, using one or more processors, analog and/or digital hardware, custom designed circuitry such as PLAs, and/or firmware. Further, although decoder 106 and message generator 108 are coupled via cable 116, it will be appreciated by those skilled in the art that in other embodiments other arrangements, e.g., networks, optical, shared components, wireless and other means for communication can be used.

Footswitch 110 is illustrated as electrically disposed between the message generator 108 and light-system 112 via electrical cables 118 120, respectively, and can receive finger position data from the first instrument 104 and communicate finger position data to the second instrument 102. Footswitch 110 illustrated has having two foot-activated buttons 122 124, however there can be more or less foot-activated buttons in differing embodiments. Illustrated, however, each button 112 124 can toggle functions or make selections in the operation in the message generator 106 and/or allow a user to manipulate the lights on the second instrument 102. For example, the message generator 108 can receive inputs from the first player or teacher via pressing a button 112 and/or 124 on the footswitch 110 causing a finger position(s) illuminated on the second instrument 102 to remain illuminated even after a string has stopped vibrating (or when the strength of the string vibration has dropped to an undetectable level). Thus, the finger position played on the first instrument is "painted" on the second instrument until a further input is received by the message generator 108 to instruct light system 112 to proceed or otherwise change the display. By way of further non-limiting example, button 122 and/or 124 can toggle whether the message generator 108 creates messages corresponding to right-handed or left-handed second stringed instruments, that is, to switch the "handedness" of the second instrument.

Turning now to the second instrument 102, there can be multiple second instruments 102, and such as would be appropriate for a class of students, for example. Thus, an instructor can play a note or notes on the first instrument 104, and corresponding finger positions will be displayed on each of the second instruments 102. Thus, the instructor can have multiple students.

Second instruments 102 can have a sensor 128 that operates generally as described above in conjunction with decoder 106 and message generator 108. Thus, feedback can be provided to an instructor or to a computer program, for example, to determine whether a student playing the second instrument 102 played the correct note. For example, the first instrument 104 can have a light-system that displays the finger positions played on the second instrument 102. In one embodiment, a separate display such as a computer screen or other display device can illustrate finger positions played on one or more second instruments, thus, enabling an instructor to receive feedback from multiple second instruments. In the case of pre-recorded lessons and/or other music/finger position lessons, the message generator 108 can compare feedback from the second instrument with pre-recorded finger positions to make such determination. A wide variety of exception handling can be programmed into the message generator 108, e.g., continue after receiving a correct response from the second instrument, repeat last instruction until a correct feedback response is received, or provide further instruction when an erroneous finger position is played on the second instrument, to enumerate but a few exception handling routines. Of course, those skilled in the art will appreciate that a virtually any action—or note at all—can be utilized upon receiving feedback indicating a correct or erroneous finger position was played on the second instrument.

Referring to the first instrument 104, it does not have to be located in proximity with the one or more second instruments 102. For example, the instructor using a first instrument 104 may be located in a studio and each of the students using a second instrument may be located at their respective homes connected with the instructor via Internet. One skilled in the art will appreciate that the first 104 and second 102 instruments can have a variety of physical locations dependant only on the ability to communicate between the first and second instruments. In one embodiment, the second instrument is coupled to a processor located in proximity to that second instrument, and the first instrument is coupled to a processor located in its proximity where the processors are coupled via wireless, Internet, network, or other communication means. Of course, wherein the second instrument is in proximity to the first instrument, the processors are merged into a single processor.

While the word "instructor" or "teacher" is used herein, it should be appreciated that the player of the first instrument need not be a guitar teacher. For example, a well known artist can play the first instrument and the "students" may observe differing finger patterns used by that artist. Further, the first instrument need not be played in real-time, but the "lesson" may be recorded or otherwise delayed for transmission to the students. Thus, it is possible to provide a pre-recorded medium, e.g., a CD or DVD/HDDVD, containing information necessary to display finger positions on the second instrument(s), as already noted above.

FIG. 2 shows a further embodiment of an apparatus according to the invention that has a footswitch 202 that receives signals from a pickup 126 mounted on or embedded in a first instrument 104, and generates finger positions information that is received by a light-system 112 in a second instrument 102. The footswitch 202 has a decoder and a message generator having functionality such as described above, but packaged in a single enclosure, and indeed, can be implemented on a single or more processor executing one or more computer programs, or using a wide variety of hardware, software and/or firmware components. A display 204 provides operational parameters and other information to a user, and in one embodiment, provides means for selecting operational parameters including manipulating the light of the light-system 112. Footswitch 202 is illustrated as coupled to sensor 126 via electrical cable 206, and also coupled to light-system 112 via electrical cable 208. In one embodiment, however, other communication techniques are used, e.g., wireless, networked, Internet, and others such as listed above. Electrical requirements are provided via electrical cord 226, however, footswitch 202 can have an internal power supply, e.g., batteries. Thus, it will be appreciated by those skilled in the art that footswitch 202 provides a very portable single package control system.

Figure 3:
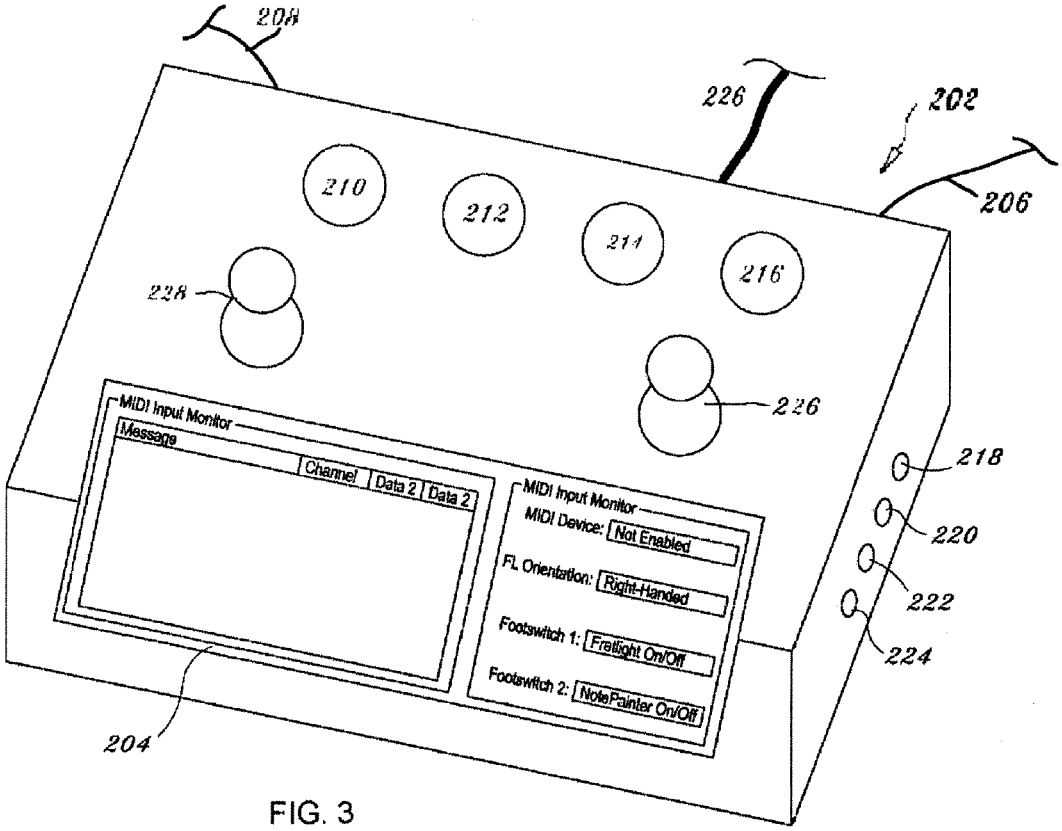
FIG. 3 is a detailed view of the footswitch shown in FIG. 2.

Details and features of footswitch 202 can more easily be understood in conjunction with FIG. 3 and the following description. Footswitch 202 has a display 204, illuminating indicators 210-216, input selection push-buttons 218-224 and two foot-activated switches 206 208. Note/chord information from sensor 126 (FIG. 2) is received via electrical cable 226. Generated messages containing finger position data are transmitted to the light-system 112 (FIG. 2) via electrical cable 208.

Display 204 can be a substantially flat display of a liquid crystal variety, and is capable of displaying information to a user. In general, it can display MIDI input information and selections related to operation of the footswitch 202, e.g., the decoder and/or message generator embedded in the footswitch 202, including error messages, operating parameters and the like. Further, it can display operating selections such as the status of a MIDI Device, whether the output is generated for a right-hand or left-hand instrument, whether the light-system 112 of the second instrument 102 is active or inactive, and whether sequential finger positions displayed by the light-system 112 should be in real-time with respect to the first instrument 102, toggled via a foot-activated switch 206 (e.g., "painted"), or otherwise delayed or slowed. Of course, it will be appreciated by those skilled in the art that those features listed herein are non-limiting examples and the display can be of other varieties and curved or non-flat. Further, display 204 can be of a tactile variety such as a so-called touch screen, and in that case, input-selections push buttons 281-224 may be omitted or otherwise have a fewer number since selections can be made by touching the screen 204.

Indicators 210-216 can be illuminated by the message generator and/or decoder in footswitch 202 to indicate that certain functions and/or selections are active, and additionally or alternatively, can indicate a status of information received or ready to be communicated to the light-system 112. For example, if indicator 210 is illuminated, the user can be alerted that the message generator is in a paused state meaning that finger positions from the first stringed instrument are being received and held in queue, waiting for the user to toggle (via foot-activated button 206) to output the next finger position played on the first instrument 104. Indicator light 212 can be illuminated to indicate to the user that the MIDI device is in a tuning mode rather than a playing mode. Those are only examples and those skilled in the art will appreciate that there may be more or less indicators, each alerting a user of a state or operating selection of the decoder and/or message generator.

Input selection push-buttons 218-224 can be used to provide binary or other inputs. Although push-buttons 218-224 are illustrated as push buttons, in other embodiments that can be virtually any device that is capable of providing an input, and indeed, they need not provide only binary input (e.g., on and off), but rather, can be multi-selector capable of multiple positions, each position a discrete input. Such is the case where multiple-position switches are used. In any event, input selection push-buttons illustrated correspond to operational selections of the apparatus, for example, to enable or disengage the MIDI device, operating in right-hand or left-hand mode, place the light-system in operating or off mode, and to generate signals to the light-system in real time or change the indicator lights only when requested, or to allow a user to manipulate the light of the light-system 112. Of course, those are just examples, and others will be appreciated by those skilled in the art.

Footswitch 202 can be powered via power cord 226 that is illustrated as a standard power cord suitable for providing household voltage and current to the footswitch 202, although in one embodiment a transformer type plug is provided where the footswitch 202 requires a lower voltage, e.g., a 12 volt system. Alternatively, footswitch 202 can be powered by internal or external batteries, although such arrangement can restrict operating duration due to power considerations.

Figure 4:
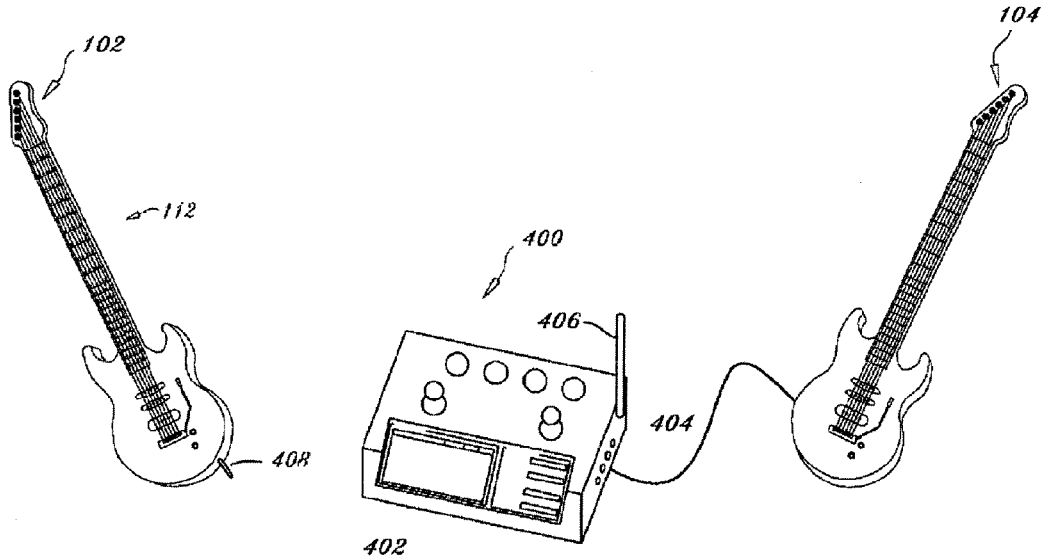
FIG. 4 illustrates an embodiment of the invention having footswitch with a wireless communication device, a decoder and a message generator that detects finger positions played on a first instrument and communicates those finger positions to a second instrument having a wireless communication device and light-system that displays those finger positions on the second instrument.

FIG. 4 illustrates a further embodiment of a footswitch 400 according to the invention that has a wireless communication device 406 coupled to or integrated with a decoder and message generator as generally described above, and is packaged as a footswitch 400 also as generally described above (FIG. 2). The wireless communication device 406 is compatible with a second wireless communication device 408 that is coupled to the light-system 112 of the second stringed instrument 102. It will be appreciated by those skilled in the art that wireless communication can be any communication between devices that utilizes air-waves as a medium, and includes 802.11 standards, Bluetooth technologies, burst and/or radio frequency including AM and/or FM frequencies, for example, but preferable, communication devices 406 and 408 are compatible.

Figure 5:
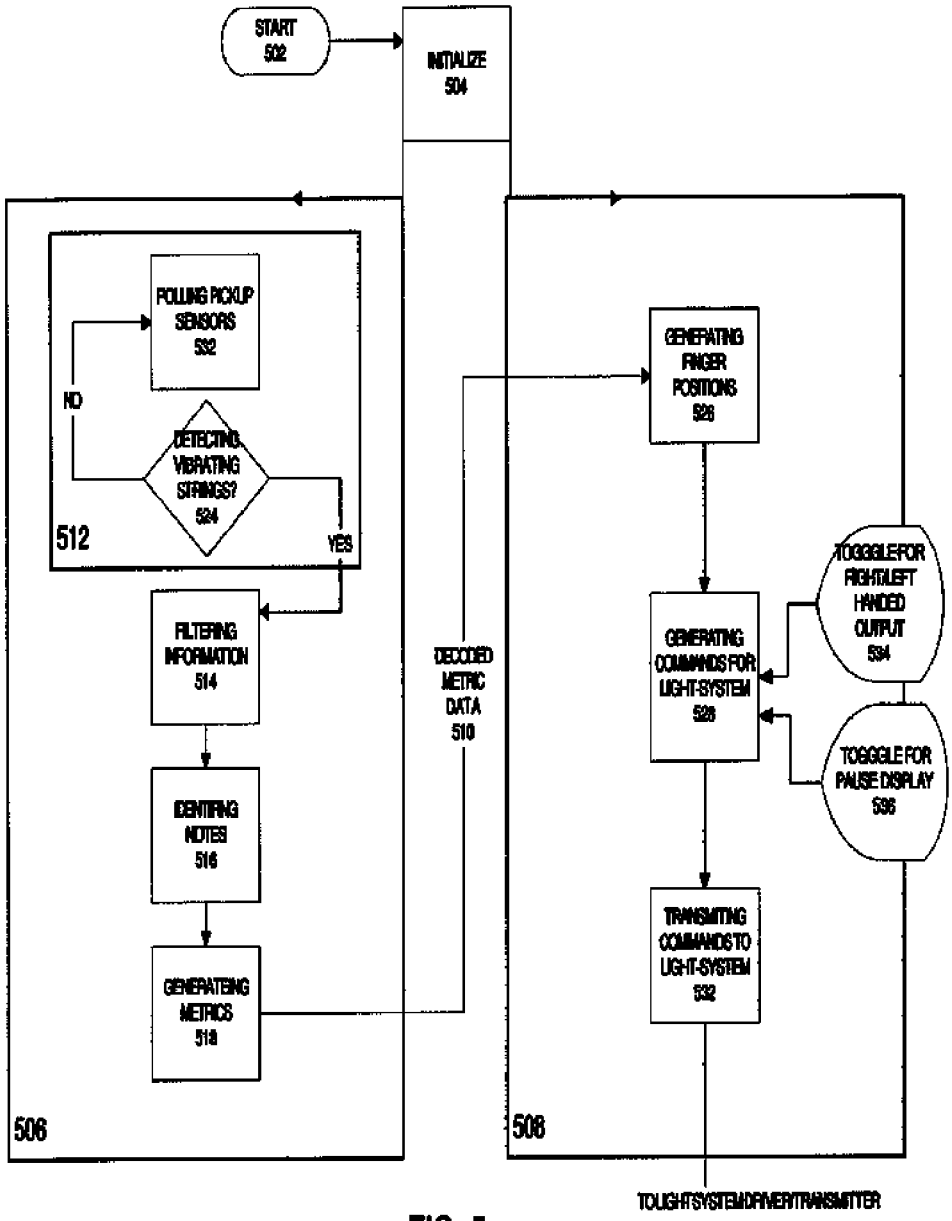
FIG. 5 is a flowchart showing a method for transmitting messages to a light-system for displaying finger positions.

FIG. 5 is a flow chart 500 that shows a method according to the invention for identifying finger positions played on a first stringed instrument and communicating those finger positions to a light-system of a second stringed instrument. Subsequent to starting 502 and initializing 504 a control system, the steps of decoding 506 and generating messages 508 are performed. Although decoding 506 is a prerequisite to generating messages 508, generally, the steps can be performed asynchronously and decoded metric data 510 can be pipelined or otherwise provided for generating messages as is becomes available. Thus, it can be advantageous to implant a control system on a multi-processor system, or on a single processor that has a capability to perform the steps of decoding and generating messages quickly enough to allow real-time processing of incoming sensor data without noticeable delay in generating messages for a light-system.

The step of decoding 506 involves detecting vibrating strings 512 for producing string data, filtering the string data 514, identifying notes 516 based on the string data and generating metrics 518 based on the notes played. Although the steps can be implemented using a wide variety of methods, as illustrated, they are described herein to provide an understanding of a high-level method for decoding music played on a stringed instrument.

Detecting vibrating strings 512 can be accomplished using a variety of methods, but as illustrated, polling 532 sensor such as the ones described above (e.g., the sensors sensing each string) is performed at timed intervals. Sensors of that type produce a sine wave signal having a frequency of the vibrating string it is sensing, and corresponding amplitude. Preferably an amplitude threshold is selected to determine whether the amplitude is of sufficient magnitude to indicate a vibrating string or rather merely an induced vibration from other causes, e.g., other vibrating strings or movement of the instrument in the hands of the user during normal playing. Further, timing of the polling must be of selected such that notes played concurrently (e.g., in a chord) are detected as being played together, yet also able to detect transitions between notes played to detect a subsequent note and/or chord. Those skilled in the art will appreciate that polling of sensors can be accomplished in other ways, and indeed, polling is not necessary when digital or other active type sensors are used, and/or parallel monitoring is used, and detecting vibrating strings can be accomplished differently depending on different pickups and sensors selected for use. If one or more vibrating strings are detected, the vibration data is filtered.

Filtering 514 of the string data removes extraneously data so that a note identifier metric can be determined based on the frequency of the string. Extraneous data includes, but is not limited to, harmonics, noise induced from adjacent vibrating strings, and other noises. In one embodiment, sensor data can be digitized and a numerical filtering process can be used to filter string data. Advantageously, because metrics are generated rather than a digitized music, filtering can be accomplished using methods with less precision that would otherwise be necessary were the music to be recorded by digital means, e.g., in WAV format. In one embodiment, hardware/firmware can be implemented for filtering the sensor data, although it can also be accomplished using software implemented on a processor or any combination thereof.

Generating metrics 518 involves identifying notes 516 and producing quantified metrics 518 based on the notes. Identifying a note 516 can be accomplished by utilizing look-up tables, numerical analysis, or other methods that will be appreciated by those skilled in the art. A given note can be determined based on the frequency of a string, thus, when the string and frequency is known, the note can be determined and hence, a quantified metric assigned. Preferably, an error threshold is set to account for variances of the frequency, e.g., tuning constraints, finger misplacement within a given tolerance, and vibrato characteristics of the note. Thus, a given note can be within a upper and lower bound of a frequency, but consideration should be given should the frequency of notes overlap as that would produce ambiguity that could only be resolved using further methods not illustrated here, but that would be appreciated by those skilled in the art, e.g., artificial intelligence or anticipatory algorithms. In one embodiment, identifying notes 516 also performs chord analysis wherein multiple notes, each played on a respective string, are passed for producing metrics, and indeed, each string may be assigned a channel or other identifier and be processed independently of other channels.

Generating metrics 518 can also be accomplished by utilizing a look-up table containing string data related to note data. Metrics can include such items as a string identifier or channel number (e.g., a number between 1 and 6) and an identification of the note played on that string (e.g., a number between 1 and 128). Additional metrics can be defined and used such as note-on/note-off data, relative volume of the played note, and other, and may be useful in embodiment where the played music is also recorded for future playback, for example, through so-called MIDI synthesis.

Turning now to generating messages 508, metric data 510 can be used for generating finger positions 526. A given note played on a given string can be applied to a lookup table, for example, indicating a finger position engaged along that string. Further, notes of a chord can be packaged or otherwise grouped to produce chord data. Of course, in other embodiments other methods can be used to determine a finger position such as formulas and/or analysis.

Generating commands 528 produces finger position data, e.g., instructions or messages, for a light-system to illuminate one or more LEDs in an LED matrix in accord with the finger positions generated as described above. The light-system has an LED matrix disposed in a fingerboard of a stringed instrument, here, in at least the second stringed instrument. Commands cause the light-system to activate and/or de-activate selected LEDs of the matrix, allowing a player of the instrument to visualize finger positions. Each note or chord played is represented by at least one light of the light-system.

Generating commands 528 can include operational features and/or selections that produce desired messages to the light system, and that allow a user to manipulate the light-system or its lights. For example, one operational feature results in messages suitable for use with a light-system in a left-handed instrument 534. Another operational feature results a pause function 536 that maintains a current illumination pattern rather that progressing to a next finger position pattern in real time. That allows a student to study a finger position for a time period before proceeding to a next finger position. To accommodate that function, subsequent light-system messages can be queued by the message generator, for example, and issued upon request, e.g., via a foot-activated switch.

Transmitting commands 530 involves the steps of moving or otherwise commutating commands to a driver and/or transmission device. For example, if a light-system receives commands via a USB port, commands would be communicated to an appropriate driver. Further, should the light-system be in wireless communication, that appropriate driver would be utilized.

Thus, through use of control system such as those described here, a method of teaching the use of a stringed instrument is possible. The method includes obtaining a first stringed instrument, that instrument having at least one string and a pickup mounted thereon or therein. Then, the method includes a step of coupling the pickup to a control system, the coupling being any means for the pickup to send to the control system information regarding vibrating strings on the first instrument, e.g., wire, cable, wireless transmission, or otherwise. Then, the method includes a step of obtaining a second stringed instrument having a light-system. The second stringed instrument can, but need not, be similar to the first stringed instrument. The light-system is as generally described above and preferable has a light-matrix disposed in the fingerboard of the second stringed instrument, each light disposed such that when illuminated it indicates a finger position to be engaged by the student playing the second stringed instrument. The method includes a next step of coupling the second stringed instrument to the control system using any technique that is appropriate, e.g., wire, cable wireless transmission, internet or otherwise. The method includes a next step of the teaching playing one or more notes on the first instrument, causing the finger positions played by the teacher to be illuminated on the second instrument. The method includes a next step of the student observing the illuminated finger positions and engaging strings of the second stringed instrument at those finger positions. Thus, the student is taught to play the second stringed instrument.

Further provided herein are methods for instructing one or more students. One or more sensors 126 can be installed on a first stringed instrument 104, preferably a frequency-detecting sensor for each string of that instrument. An instructor can couple or otherwise connect (or initiate a wireless connection) to a first digital processor 108 (or interface thereto) using any of a plurality of means such as USB, parallel, wireless, optical, Infra-Red or other communication means. The student(s) can couple a second stringed instrument 102, respectively, having a light-system 112 to a digital processor which can be the first processor 108 mention above or a separate processor that can receive and/or send information to/from the first processor. In a first step, the instructor plays a note or notes, or a series of notes and/or notes using finger positions. The sensors 126 detect/collect string vibration information and communicate that information to the first processor 108. The processor 108 (and/or a program associated with the processor) determines which finger positions were played on the first instrument 104. Those finger positions are communicated to the second instrument(s) 102 either directly or via a second or more processors. The one or more second instruments 102 receive data from the first processor 108 and illuminate the finger positions along the light-system corresponding to the first instrument.

Illustrative embodiments of the invention being thus described, variations, modifications and adaptations to various processing devices and chassis configurations will occur to those skilled in the art, and these are considered to be within the spirit and scope of the invention. Accordingly, the invention is not to be limited by what has been particularly shown and described, but is understood to encompass such variations, modifications and adaptations as will occur to those skilled in the art, as defined by the claims appended hereto and equivalents thereof.

What is claimed is:

1. A system for displaying finger positions on a second instrument based on finger positions played on a first instrument, the system comprising:

a first instrument having at least one sensor configured to detect a finger position and transmit a first signal to a communication link, wherein the first signal includes data encoding the finger position played on the first instrument; and a second instrument having a light-system configured to display a finger position and receive a second signal from the communication link, wherein the second signal includes data encoding the finger position to be displayed on the second instrument and at least part of the communication link includes an internet connection.

2. The system of claim 1, wherein the finger position is displayed on the second instrument at substantially the same time the finger position is played on the first instrument.

3. The system of claim 1, further including a plurality of second instruments in communication with a plurality of communication links, wherein each of the plurality of communication links is configured to permit transmission of data from the first instrument to at least one of the plurality of second instruments.

4. The system of claim 1, further comprising a hardware system configured to receive the first signal from the first instrument and transmit the second signal to the second instrument.

5. The system of claim 4, wherein the hardware system includes a user interface adapted to allow a user to manipulate the light-system on the second instrument.

6. The system of claim 1, further including a processor configured to receive the first signal from the at least one sensor and transmit the second signal to the light-system.

7. The system of claim 6, wherein the processor is disposed in at least one of a footswitch, the first instrument, the second instrument, a personal electronic device, and a computer server.

8. The system of claim 6, wherein the processor comprises a decoder and a message generator.

9. The system of claim 8, wherein the decoder is coupled to the at least one sensor and receives the first signal from the at least one sensor to determine a frequency of a vibrating string.

10. The system of claim 8, wherein the message generator outputs data encoding a finger position.

11. The system of claim 1, wherein at least part of the communication link includes at least one of electrical wires, electrical cables, wireless transmissions, digital networking, digital communications, radio frequencies, and optical coupling.

12. The system of claim 1, wherein the at least one sensor is adapted to detect the vibration of one or more strings.

13. The system of claim 12, further including a processor adapted to receive vibration data from the at least one sensor and determine the frequency of at least one string.

14. The system of claim 1, wherein the second instrument has at least one sensor, the second instrument being adapted to cause finger positions played on the second instrument to be communicated to at least one of a processor, a first instrument having a light system, and a further second instrument.

15. The system of claim 1, wherein the second instrument has a fingerboard, the fingerboard comprising:

an elongated structure having a top surface and a bottom surface, the bottom surface sized to be disposed on an upper surface of a neck base of the second instrument, the top surface having at least one finger position; and an opening in the bottom surface and a well extending therefrom toward, but not through, the top surface, the well sized to receive a light-emitting device and has a height measured from the bottom surface to allow light from the light emitting device to be visible to a player of the instrument, the opening disposed at a location designating the finger position on the top surface.

16. A system for transmitting data from a first instrument to a second instrument, comprising:

a first stringed instrument having a sensor configured to detect a finger position; and a second stringed instrument having a light-system configured to display the finger position, wherein the second instrument is in communication with the first instrument via communication link configured to permit transmission of audio/visual information associated with at least one of the first instrument and the second instrument.

17. The system of claim 16, wherein the audio/visual information includes at least one of a training lecture, a training video, a pre-recorded concert, and an artist playing an instrument.

18. A method for teaching, the method comprising:

playing a first instrument having at least one sensor configured to detect a finger position, wherein the first instrument is configured to communicate with a second instrument having a light-system via a communication link that includes a network connection; and displaying the finger position played on the first instrument on the second instrument by selectively illuminating one or more lights of the light-system.

19. The method of claim 18, wherein the one or more illuminated lights are displayed on a fretboard.

20. The method of claim 19, further including the step of controlling the one or more lights of the light-system with a user interface.

21. The method of claim 20, further including the step of pressing a button on a hardware system to turn the one or more lights on the second instrument on or off.

22. The method of claim 20, wherein the one or more lights on the second instrument remain illuminated as the at least one sensor detects finger position information.

23. The method of claim 22, wherein pressing a button on a hardware system causes the one or more lights on the second instrument to remain illuminated after the at least one sensor no longer detects finger position information.

24. The system of claim 1, wherein the communication link is configured to permit transmission of data from the second instrument to the first instrument.

25. The system of claim 1, wherein the first instrument is configured to transmit the first signal and the second instrument is configured to receive the second signal.

26. The system of claim 4, wherein the hardware system is located remotely from the first instrument and the second instrument.

27. The system of claim 16, wherein at least part of the communication link includes an internet connection.

28. The system of claim 16, further including a hardware system configured to receive and display audio/visual information relating to the finger position.

* * * * *